US005226468A

United States Patent [19]

Lord

[11] Patent Number: 5,226,468

[45] Date of Patent: Jul. 13, 1993

[54] KITS INCLUDING GRIPPING BANDS FOR ATTACHING PIECES OF FABRIC AND BATTING IN ORDER TO PRODUCE DECORATIVE ARTICLES

[76] Inventor: Gilles Lord, 810 Covey Hill, Hemmingford, Quebec, Canada, J0L 1H0

[21] Appl. No.: 781,380

[22] Filed: Oct. 23, 1991

Related U.S. Application Data

[63] Continuation-in-part of Ser. No. 548,672, Jul. 5, 1990, abandoned.

[51] Int. Cl.[5] ..... A47H 13/00

[52] U.S. Cl. ..... 160/399; 160/402; 160/404; 24/355; 24/536; 24/710.6

[58] Field of Search ..... 160/383, 384, 391, 392, 160/394, 395, 397, 398, 400, 402, 403, 404, 327, 399; 24/536, 537, 710.5, 355, 354, 710.6, 460, 545, 543, 563; 67.9

[56] References Cited

U.S. PATENT DOCUMENTS

| | | | |
|---|---|---|---|
| 2,350,236 | 5/1944 | Johnson | 160/398 |
| 3,181,598 | 5/1965 | Schneider | 160/403 |
| 3,214,810 | 11/1965 | Mathison | 24/536 |
| 3,513,902 | 5/1970 | Merillet | 160/392 |
| 3,524,491 | 8/1970 | Olson | 160/384 X |
| 3,763,918 | 10/1973 | Clark | 160/404 X |
| 3,783,931 | 1/1974 | Assael | 160/395 X |
| 4,974,298 | 12/1990 | Thallon | 160/404 X |

FOREIGN PATENT DOCUMENTS

| | | | |
|---|---|---|---|
| 2393966 | 2/1979 | France | 160/383 |

*Primary Examiner*—David M. Purol

[57] ABSTRACT

Kits comprising a plurality of gripping bands are provided for attaching pieces of fabric and batting together without need for sewing, gluing or sealing. These kits are related to simulated quilting and, more generally, to the art of decorative wall hanging whether in sheet, patchwork or piece form. Also provided are auxiliary tools for use with the kit during attachement of the sheets. Each gripping band of the kit comprise a pair of elongated walls flexible along their length. The walls have surfaces, hereinafter called "inner surfaces", that face each other. The walls also have adjacent edges flexible connected to each other and free edges opposite the adjacent edges, the free edges facing each other. Serrations or teeth project from the inner surfaces of the walls to grip and retain the edges of pieces of fabric or batting when they are inserted between the walls from the free edges.

22 Claims, 10 Drawing Sheets

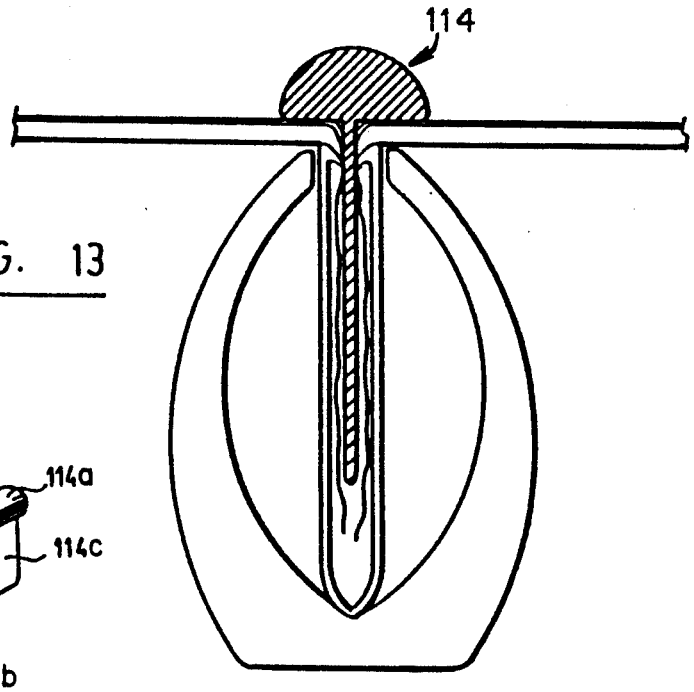
FIG. 13
FIG. 14a
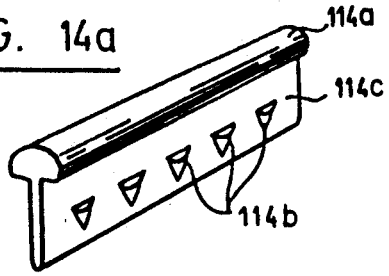
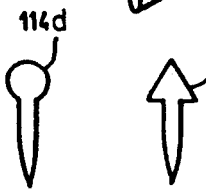
FIG. 14c
FIG. 14b
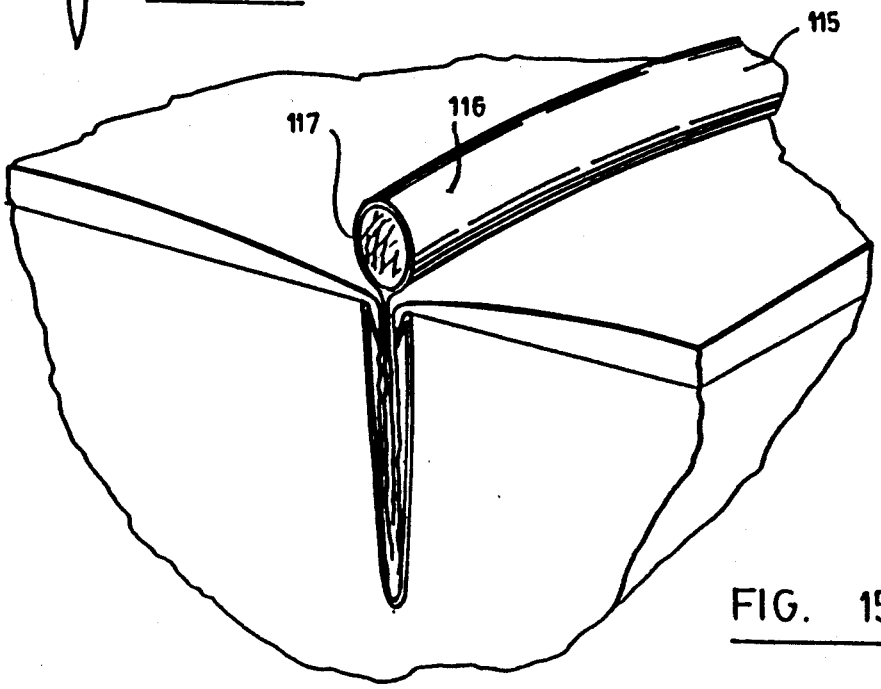
FIG. 15

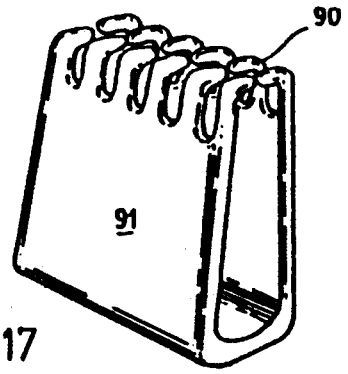
FIG. 17
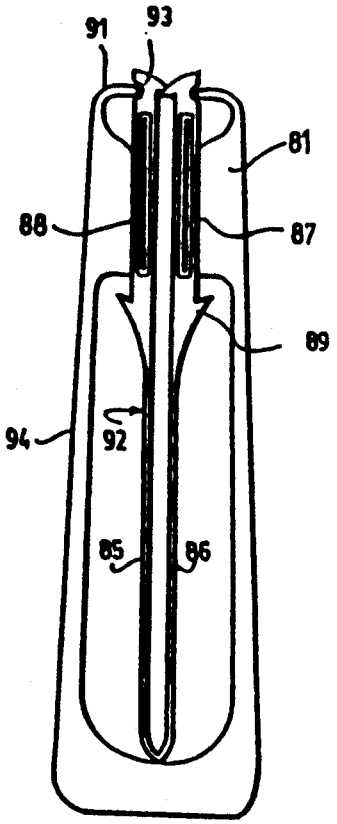
FIG. 16
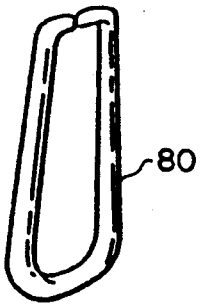
FIG. 18
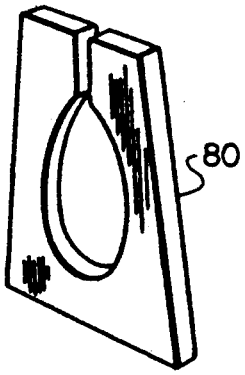
FIG. 19
FIG. 20
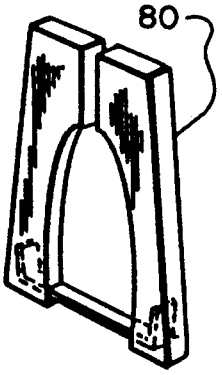

KITS INCLUDING GRIPPING BANDS FOR ATTACHING PIECES OF FABRIC AND BATTING IN ORDER TO PRODUCE DECORATIVE ARTICLES

CROSS-REFERENCE

This application is a continuation-in-part of application Ser. No. 07/548,672 filed on Jul. 5, 1990, now abandoned.

FIELD OF THE INVENTION

The present invention relates to a kit including gripping bands for attaching pieces of fabric or batting and optionally accessories for use with the gripping bands, in order to produce decorative articles such as simulated quilts.

BACKGROUND OF THE INVENTION

Creating quilted wall hanging decoration with pieces of fabric is a traditional craft, and exciting pastime and, for many, a professional activity. This decorative art has been called by a plethora of names such as: stuffed forms, people pieces, sewn paintings, stitchery collages, quilting patchwork and applique, wall quilts, wall hangings.

There is a growing need for fast, efficient and reliable methods to replace the time-consuming techniques of another era requiring exceptional skills such as needle-stitching and sewing, to produce decorative articles from pieces of fabric.

SUMMARY OF THE INVENTION

The main object of the present invention is to enable a greater number of persons to assemble quickly and easily pieces of fabric according to their imagination and decorative graphic expression, in order to produce decorative articles that will last and endure.

In accordance with the invention, kits including gripping bands are provided, for attaching pieces of fabric together without need, unless desired, for sewing, gluing or sealing these sheets. These kits are related to simulated quilting, and in general to the art of decorative wall hanging whether in sheet, patchwork or piece form. Also provided are auxiliary tools for use with the kit during attachement of the sheets.

In view of the new trend in home activities and for people with limited dexterity, the Applicant is providing means, accessories and methods for creating simulated quilts.

By "sheet", there is meant any piece of fabric or textile, whether natural, manmade, polymeric or synthetic in nature; as examples but not limited thereto are vinyl sheets, textile sheets whether woven or non-woven, some tapestries and the like. The expression "sheet" is meant to include patchmork and any kind of pieces throughout the disclosure and claims.

More particularly, the invention provides a kit to produce a decorative article from pieces of fabric or any other similar material, comprising a plurality of gripping bands for use to attach at least one edge of at least one piece of fabric or any other similar material, each of said gripping bands comprising:

a pair of elongated walls flexible along their length, the walls having surfaces, hereinafter called "inner surfaces", that face each other, the walls also having adjacent edges flexibly connected to each other and free edges opposite the adjacent edges, the free edges facing each other; and gripping means projecting from the inner surfaces to grip and retain the at least one edge when it is inserted between said walls from the free edges.

The invention also provides a kit of the above type, further comprising auxiliary tools such as guiding-wedges and/or piping-bands with or without a rigid gripping base and removable pins with handle.

BRIEF DESCRIPTION OF THE DRAWINGS

In the drawings which illustrate different preferred embodiments of the invention.

FIG. 13 is an enlarged cross-sectional view of a decorative pliable piping-band according to the invention inserted into a gripping band.

FIG. **14*a* is a perspective view of the pliable piping-band shown in FIG. 13**.

FIGS. **14*b* and 14*c*** are views in cross-section of other piping bands.

FIG. 15 is a perspective view of a substrate with a gripping band and a decorative piping inserted therein, showing how the fabric covering the piping cord is inserted into the gripping band together with the fabric and the batting.

FIG. 16 is a cross-sectional view of a further gripping band for use in a kit according to the invention.

FIGS. 17 to 20 illustrate various compressing ring configurations.

Figure 21:
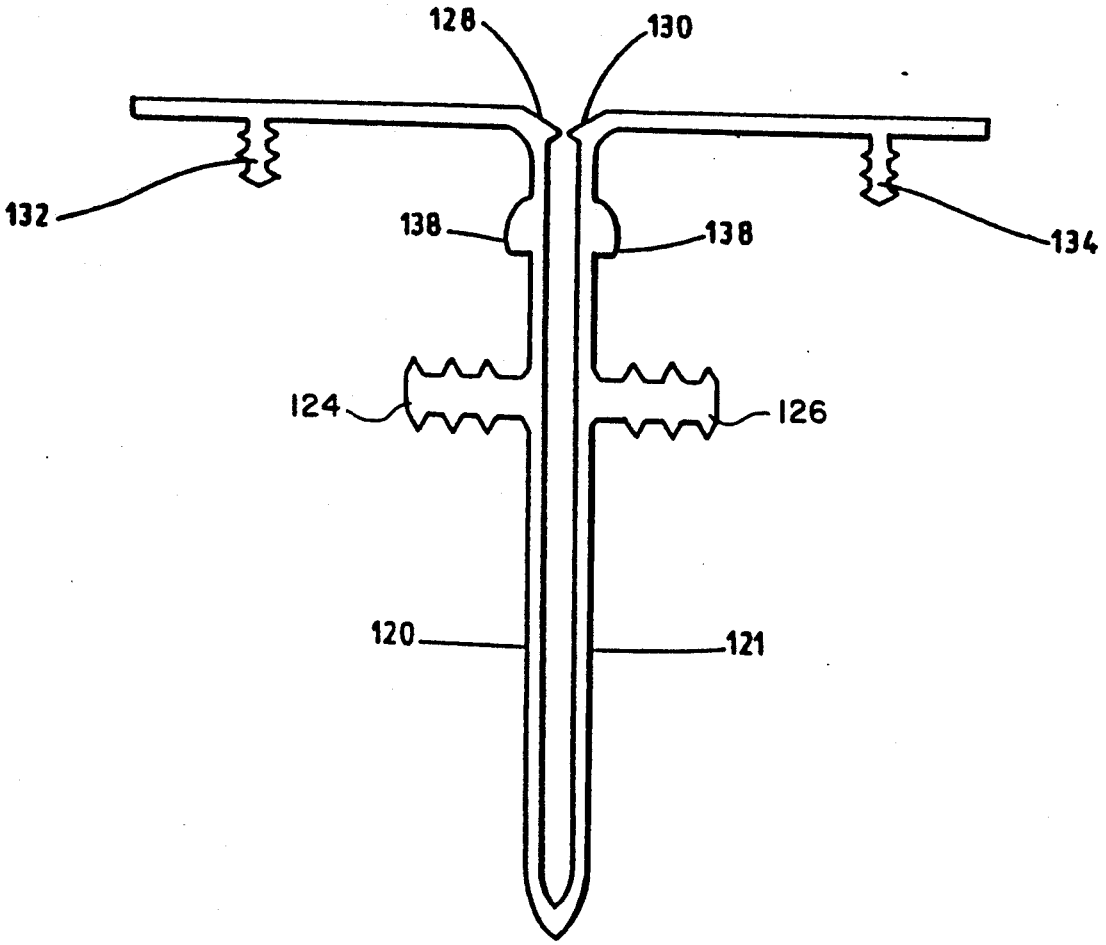

FIG. 21 is a front elevational view of still another premolded gripping band according to the invention.

Figure 22:
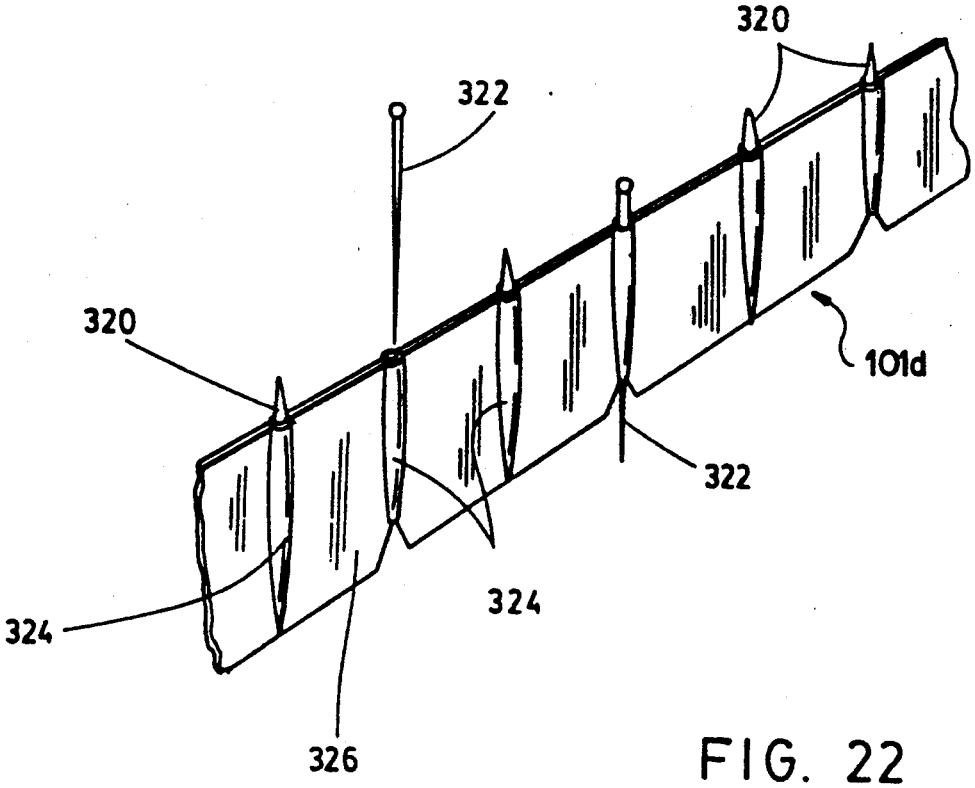

FIG. 22 is a perspective view of another guiding-wedge equipped with removable pins according to the invention.

Figure 23:
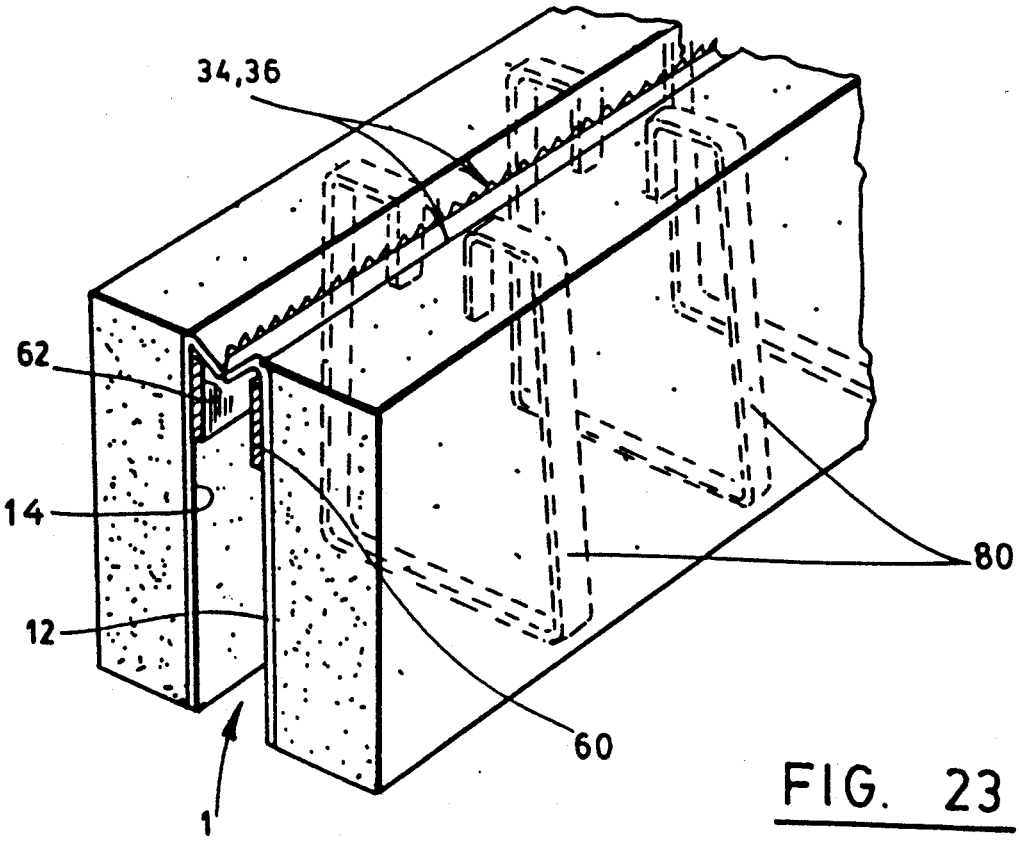
Figure 24:
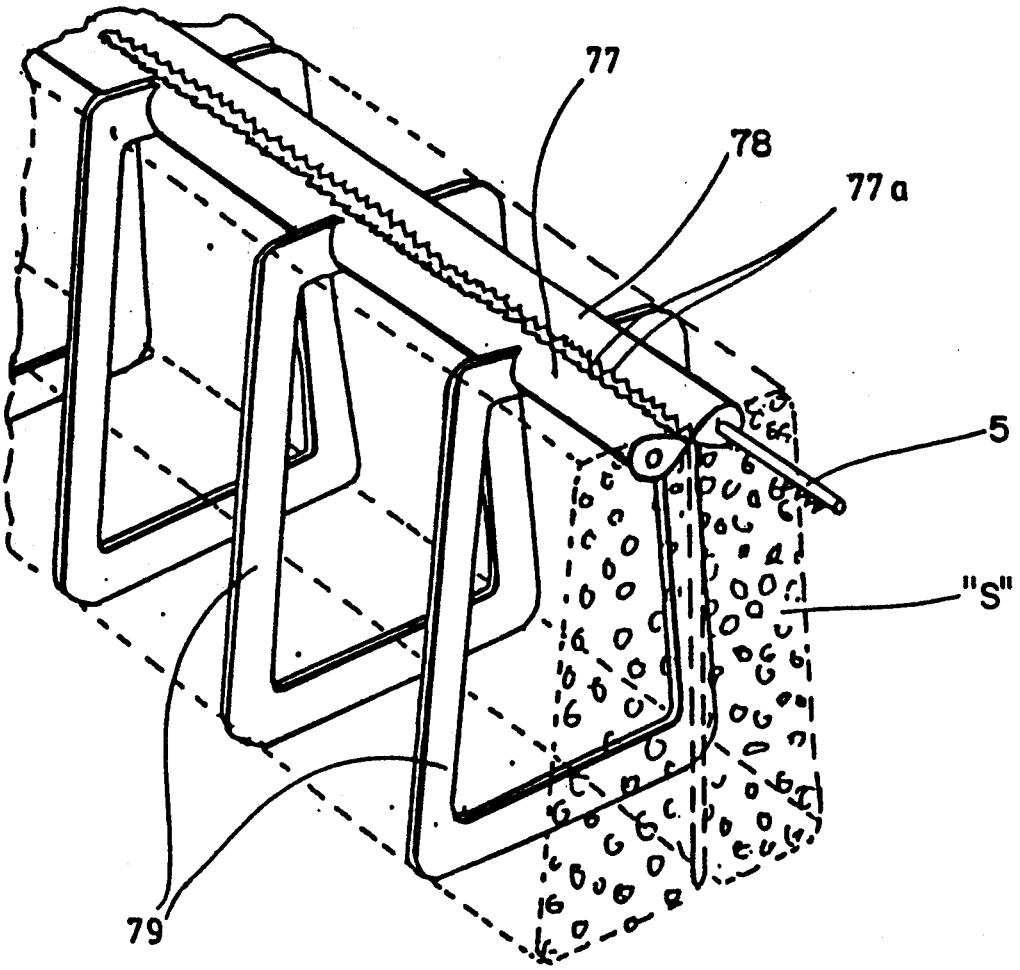

FIGS. 23 and 24 are perspective views of still other pliable gripping bands with integral compressing rings, eliminating the need for resilient or non-resilient supporting substrate.

Figure 25:
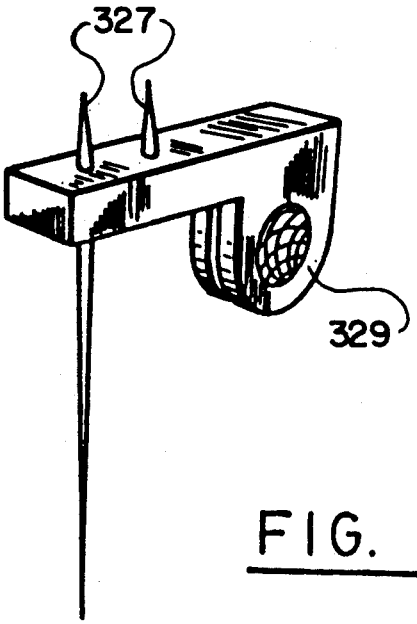

FIG. 25 is a perspective view illustrating a removable pin with handle and top spikes.

DETAILED DESCRIPTION OF THE INVENTION

Gripping Band

Figures 1, 2:
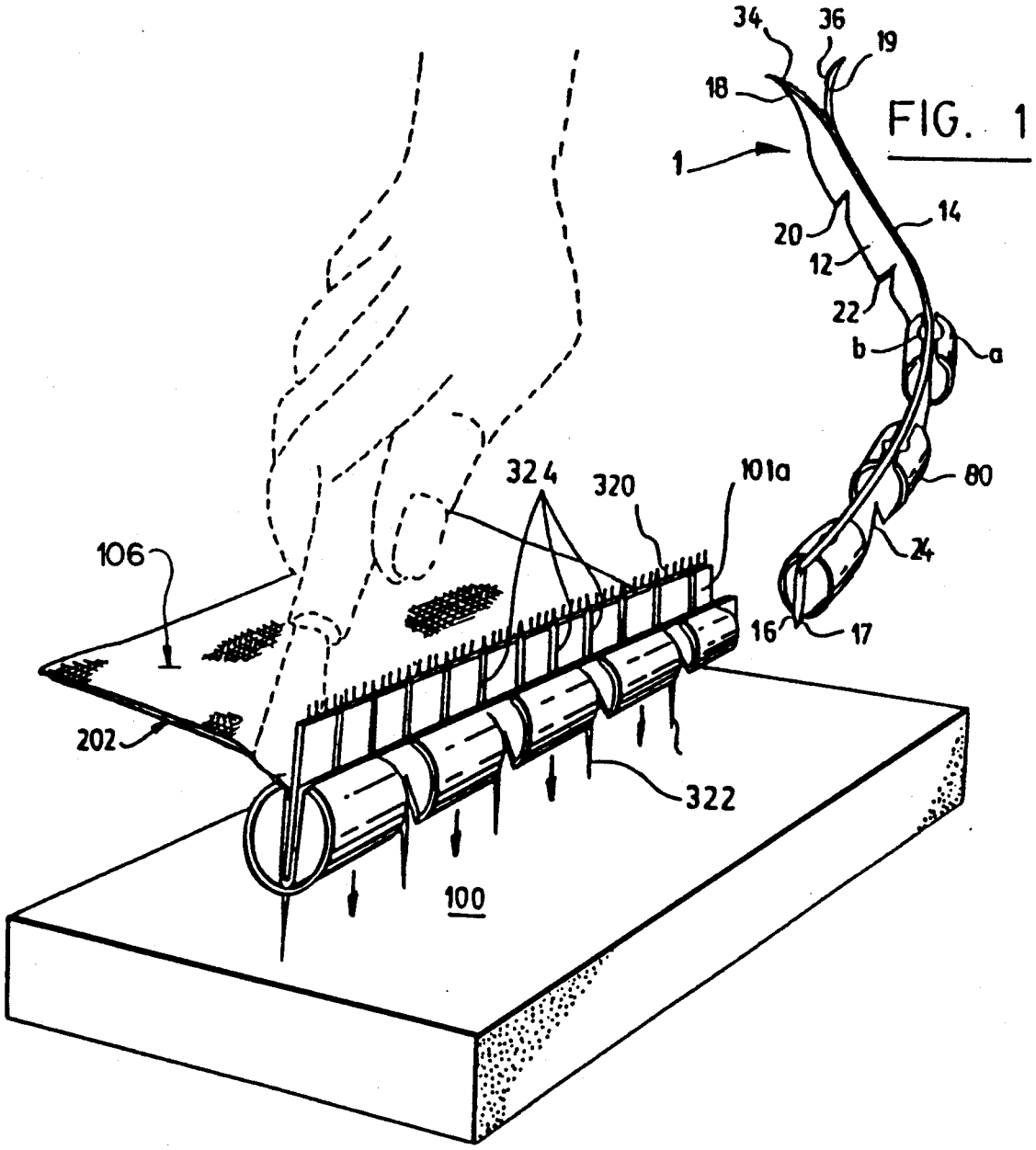
FIG. 1 is a perspective view of a gripping band for use in a kit according to the invention for attaching sheets according to the invention, provided with external compressing rings.
FIG. 2 is a perspective view illustrating the insertion of a sheet into the gripping band of FIG. 1, with the assistance of a guiding-wedge and of a round-ended blade guided with the guiding-wedge.

FIG. 1 shows a gripping band 1 useful in a kit according to the invention for attaching pieces of fabric 10. This gripping band has a pair of elongated lateral walls 12 and 14 facing each other. The walls 12 and 14 have a pair of adjacent edges 16, 17 that are flexibly connected to each other. Opposite the edges 16 and 17, the walls 12 and 14 also have other free edges 18 and 19 that face each other but are not connected to enable insertion of the sheets between the walls 12 and 14. The walls are flexible along their length and may be provided with lines of weakness to make them more flexible. These lines of weakness may, for instance, consist of cuts 20, 22, 24 made in the walls, from the edges 16, 17, which can be V-shaped.

The surfaces of the walls facing each other, hereinafter called "inner surfaces", are provided with gripping means.

As shown in FIG. 1, these gripping means may consist of serrations 34, 36 projecting from the inner surfaces of the walls 12 and 14 in a direction opposite to the free edges 18, 19.

Figure 6:
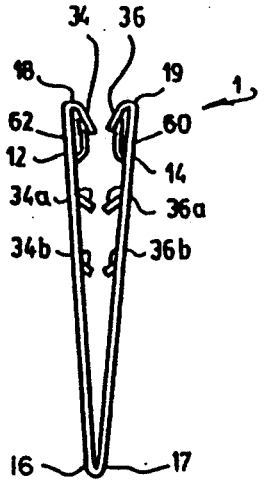
FIG. 6 is an enlarged cross-sectional view of the gripping band shown in FIG. 1.

If desired, as shown in FIG. 6, parallel rows of serrations may be punched out of the inner surfaces of the walls over their height as schematically shown at 34, 34*a*, and 34*b* and 36, 36*a* and 36*b*.

The serrations 34 and 36 (and, when elected, 34*a*, 34*b*, 36*a* and 36*b*) are preferably inwardly inclined toward the connected edges 16 and 17. These serrations are preferably flexibly joined to the free edges 18, 19. Other gripping means may be used if desired, some of which are illustrated hereinbelow. Thus, by way of example, the gripping means may consist of layers of a self-sticking coating applied onto the free edges of the gripping band.

Figure 5:
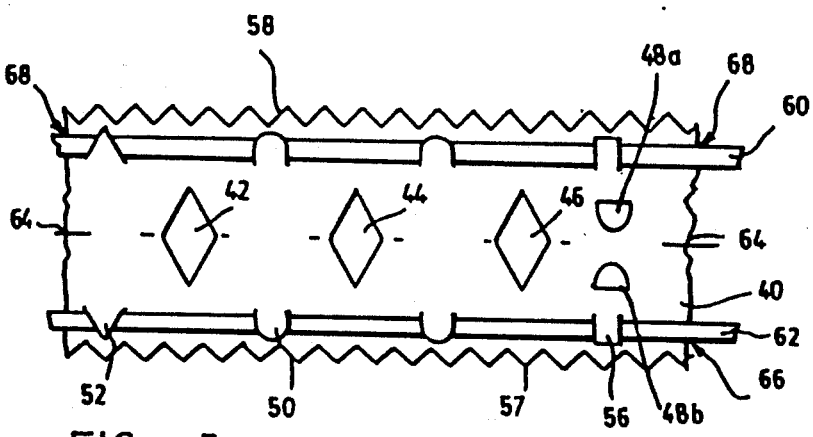
FIG. 5 is a top plan view of a blank for use to manufacture the gripping band shown in the previous Figures.
Figure 10:
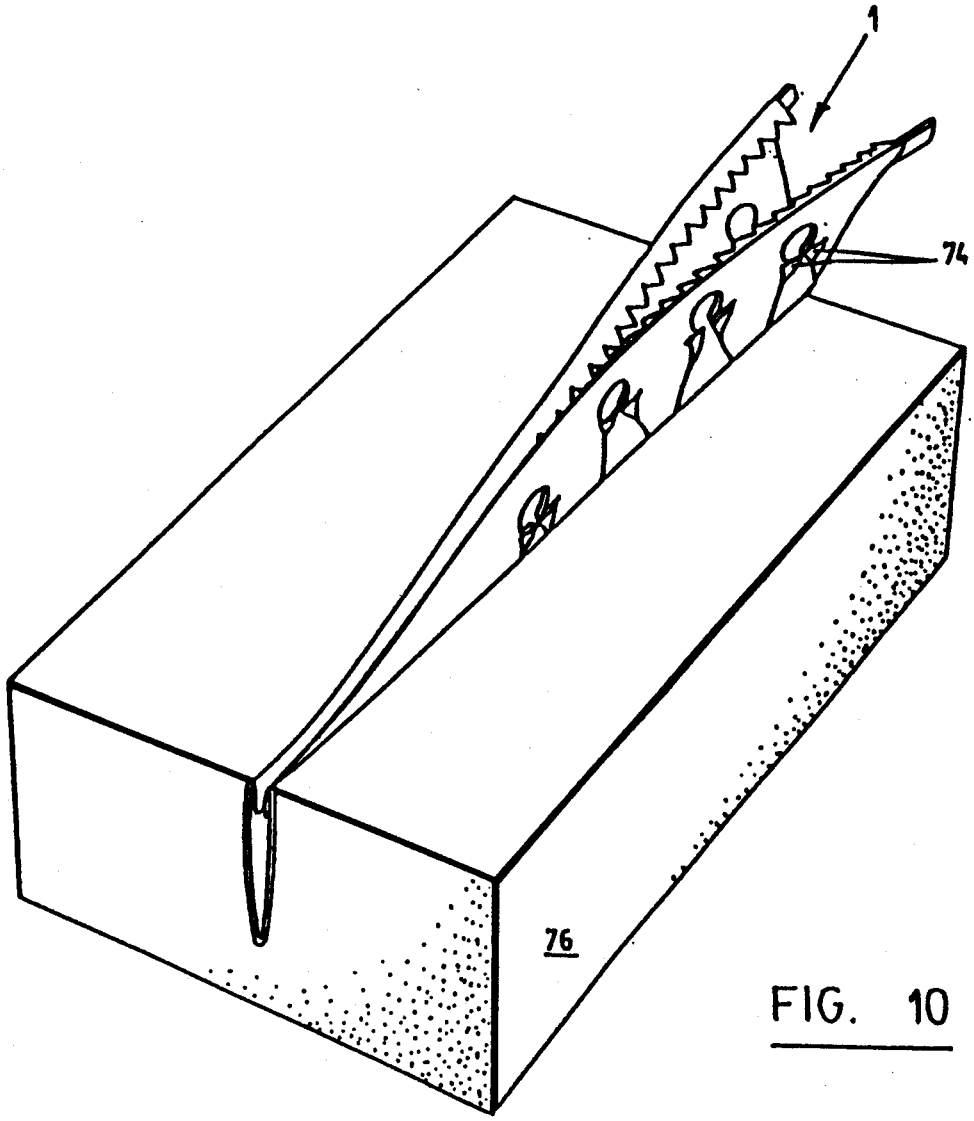

If desired, the gripping band may be made from a blank cut into a strip 40 of plastic material such as vinyl as shown in FIG. 5, the strip being provided with holes, anchoring means and serrated edges acting as said gripping means. The holes 42, 44, 46 define the lines of weakness and are obtained by die cutting. These holes may consist of a diamond-shaped cuts 42, 44, 46. Spear-shaped members 48*a*, 48*b* may be used as anchoring means, the members being cut simultaneously with the serrated edges 57, 58. These spear-shaped members may have various shapes; they may be cup-shaped (48*a*) or triangularly shaped (48*b*). Numerous other type of anchoring means can be used such as fins 74 as shown in FIG. 10 which are gradually increasing up from bottom, the fins terminating into upwardly oriented spears.

The gripping band may also be provided with cut-out tongues or tabs which may have various shapes such as semi-circular (see tongue 50), triangular (see tongue 52), rectangular (see tongue 56). These tabs project from the inner surfaces of the walls inside the gripping band toward the free edges thereof to stop short of said edges and may be used as metal strip retainers to hold metal strips 60, 62 against the walls 12, 14, respectively, close to their free edges 18, 19. Preferably, the metal strips are loosely mounted to be easily slidable between the tabs and the walls. The metal strips are made of non-resilient soft metal to allow any kind of bending or folding one wishes to make with the gripping band. These strips rigidify the gripping band and hold it in any selected angular position. They also reinforce the seam line.

The blank is folded along lines 64—64, 66—66 and 68—68 into the shape shown in FIGS. 1 and 2. If desired, the metal strips may be provided with projections 72 at given intervals matching some openings 73 made in the walls.

The gripping band need not be die cut. It may be machined, processed in a different manner and even molded as shown in FIG. 16. In this Figure, the gripping band 92 has a pair of lateral walls 85, 86 housing therein reinforcing bands 87, 88 such as loose metal strips or wires. It may also be provided with outwardly projecting anchors 89 if the gripping band is contemplated to be used without compression rings.

Compression Rings

Figure 7:
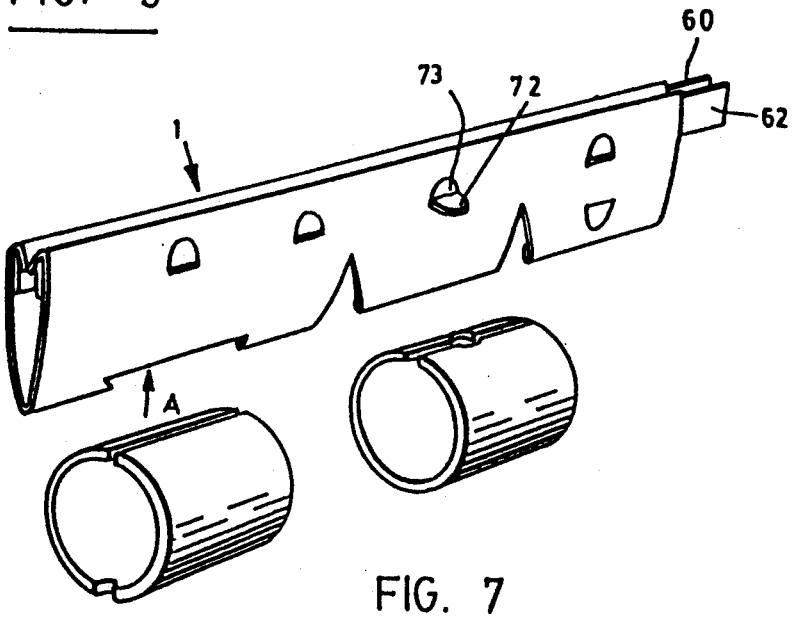
FIG. 7 is a perspective view of a gripping band provided with metal bands and compressing rings, showing how the rings can be fixed or attached to the bottom or the upper part of the gripping band.

Compressing rings 80 as shown in FIGS. 1, 7 and 23, may be used to press the lateral walls of each gripping band toward each other. If desired, each ring may be connected to the projections 72 (FIG. 7).

The walls of the gripping band may also be cut to guide and house the compressing rings (FIG. 7).

The term "compressing rings" as contemplated throughout the disclosure and claims, does not mean a circular or annular ring only, but any ring which may be oval or polygonal, which is open to fit onto the gripping band and which is resilient enough to press the lateral walls together. Examples of such rings 80 are shown in FIGS. 16 to 20, and FIG. 23.

Figure 3:
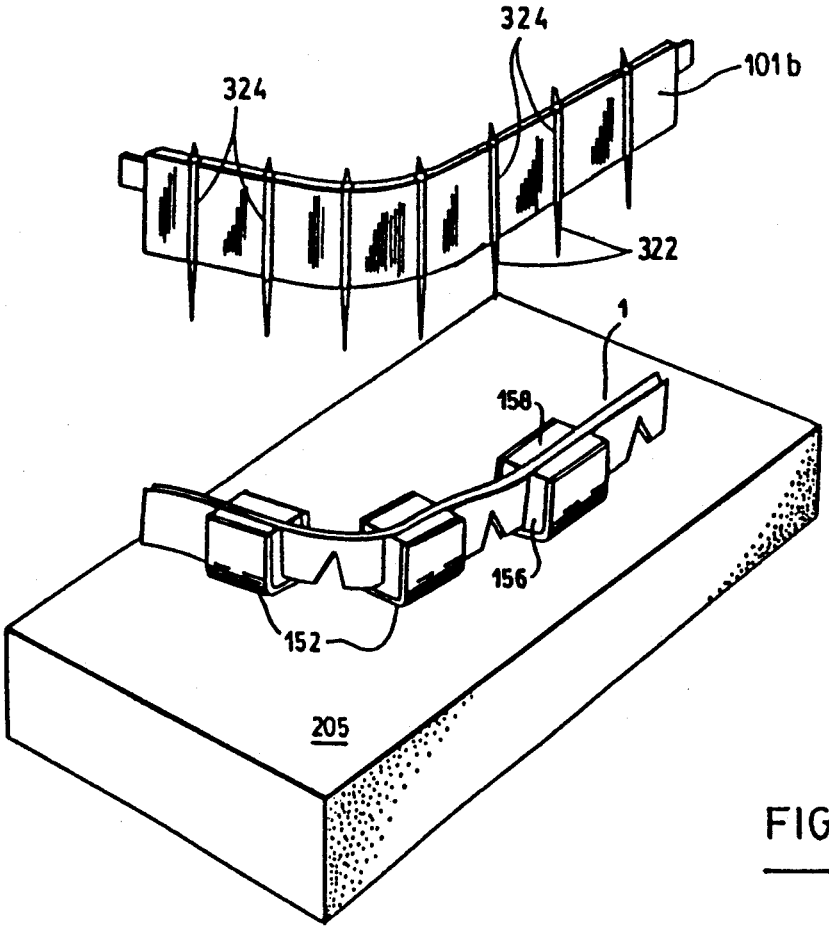
FIG. 3 is a perspective view of the gripping band shown in FIG. 1, mounted in U-shaped temporary supports.

Thus, the compressing rings may take many shapes and forms, as also shown in FIG. 3 or FIG. 13.

Figure 4:
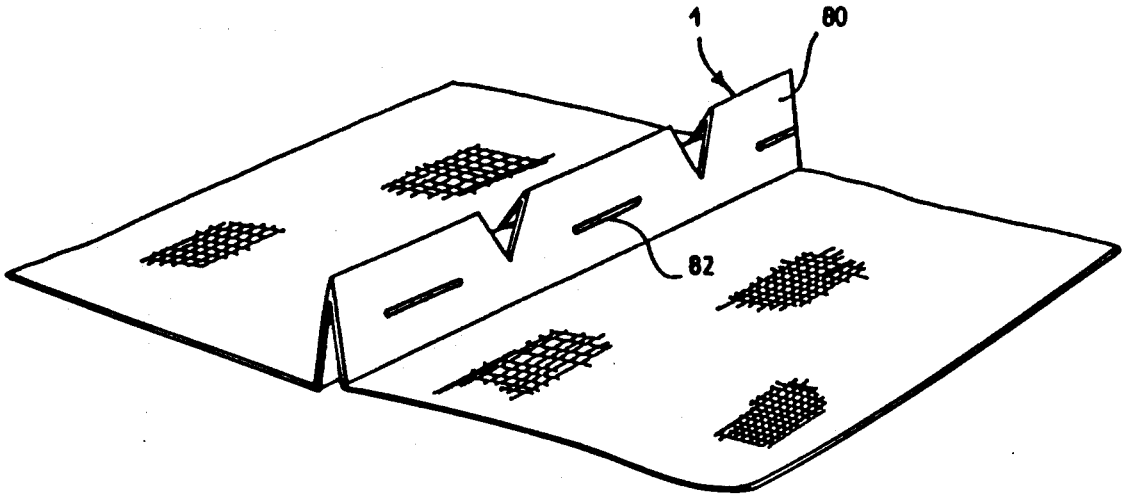
FIG. 4 illustrates the use of staples as means to compress the walls of a gripping band and patches of fabric inserted into this gripping band together.

As shown in FIG. 4, the walls of the gripping band may also be brought together by staples such as shown at 82, acting as another compressing means.

As shown in FIGS. 16 and 17, the compressing rings may also take the form of fingers 90 mounted on a U-shaped element 91, the element 91 being adapted to be mounted over the gripping band 92 with the fingers inserted into a groove 93.

Figure 8:
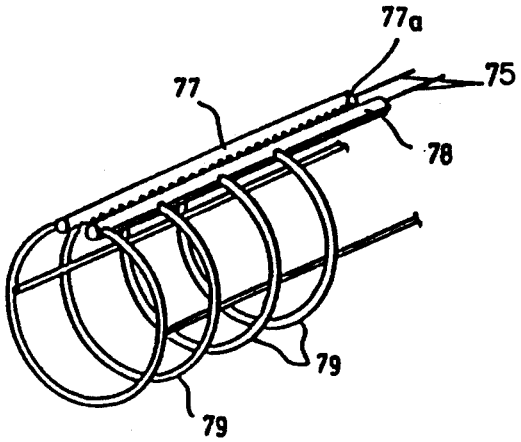
FIG. 8 is a perspective view of another gripping band according to the invention, with integral compressing rings, eliminating resilient or non-resilient substrate.

The gripping band and compressing ring may be combined into one piece as is illustrated in FIGS. 8, or 24 which show a gripping band whose walls consist of a string of compressing rings or hoops 79 having their open ends connected to a pair of edge-bars bands 77, 78 that can be reinforced with a metal wire 75. The inner of surfaces of the bars are conveniently provided with gripping means such as teeth 77*a*. In the embodiment shown in FIG. 23, the gripping means are embedded into a slotted docile string or strips made of molded elastic foam, rubber or silicone.

Other Compressing Means

Figure 9:
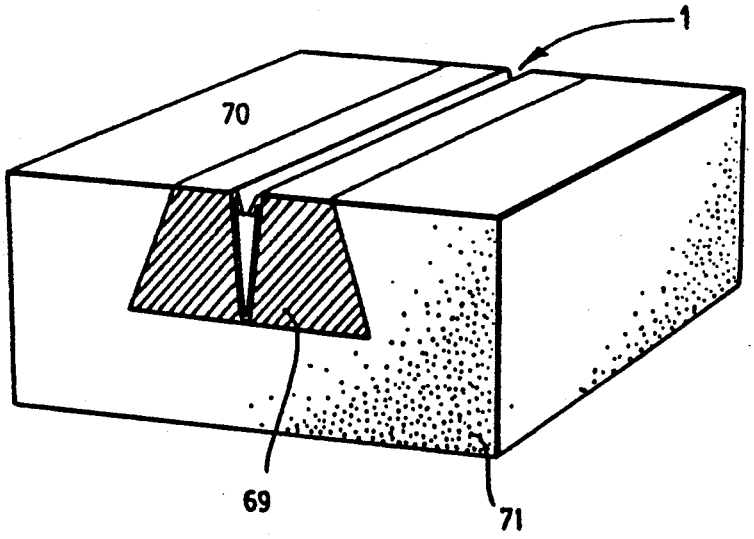
FIGS. 9 and 10 are schematic representations of the insertion of a gripping band into a non-resilient and resilient substrates respectively.

As shown in FIG. 9, an elastic foam padding 69 may act as means to compress the walls of the gripping band 1 together. If desired, the padded band 69 may be surrounded or embedded into another non resilient substrate 71, such as wood, cements, plastics, plasters, gypsum, concrete, metal.

The gripping band need not be compressed into a resilient substrate in order to secure and fasten sheets. As a matter of fact, it may be compressed by numerous other compressing means; it may even be put in a mold to be filled with plasters, concrete, cement, plastic and the like as shown in FIG. 10 at 76 and FIG. 21.

Accessories

The kit according to the invention may further include piping-bands as shown at FIG. 13 and 14 and as will be described hereinbelow, and guiding-wedge 101*a*, 101*b*, 101*c* and 101*d* as shown in FIG. 2, FIG. 3, FIGS. 11 and 12 and FIG. 22, respectively. The guiding wedges are normally thin flexible elongated members to be temporarily inserted into the grippings bands. The lateral walls of these members are serrated and/or provided with critical bulges 324. Other optimal structural features of these wedges will be described hereinafter in greater details.

EXAMPLES OF USE OF A KIT ACCORDING TO THE INVENTION, COMPRISING THE ABOVE DESCRIBED GRIPPING BANDS AND ACCESSORIES

A) Free Floating Simulated Quilted Wall Hanging Decoration in the Patchwork Tradition In the reputable world of quilted wall hanging decoration, the soft, free-floating, pliable characteristics of a traditional quilted article are paramount. In accordance with the invention, pliability is largely preserved. Kits including gripping bands equipped with compressing rings or the bands that are stapled, create an observable resemblance with the quilted wall hangings made by more traditional methods, this resemblance being referred to as "simulated quilt". This may be attained by various methods making use of a kit according to the invention, some of which being described hereinbelow.

Gripping Bands with Compressing Rings

To create a quilted wall hanging decoration, a plurality of guiding wedges 101*a* or 101*d* as shown in FIGS. 2 or 22, provided with downwardly projecting pins 322, may be inserted into a plurality of gripping bands and then into a temporary supporting board 100, along the lines of a desired pattern. Thus, a network of rigidly held gripping bands is obtained. Then, sheets of fabric 106 and batting 202 having surfaces slightly in excess to the surfaces of the "patches" defined by the lines of the pattern are positioned over their respective locations and their edges are forced fitted into the gripping bands until the patchwork assembly is completed. Therefore a fitting is facilitated by the bulges 320 or serrations provided in the walls of the guiding wedges. Finally, the pins and the guiding wedges 101*a* or 101*d* are removed and the quilted craft article is separated from the supporting board. Once again, the bulges and serrations in the walls of the guiding wedges facilitate such a removal by preventing certain fabric to be slightly pulled out of the gripping bands by excessive friction.

Gripping Band with Staples

As shown in FIG. 3, one may also use temporary U-shaped supports 152 on a temporary supporting board 205 along the lines of a desired pattern, into which gripping bands 1 have already been inserted using guiding wedges 101*b* provided with downwardly projecting pins 322. The sheets of fabric and batting are positioned and their edges inserted into the gripping bands as described above. The assembly is then separated from the supporting board by removing the pins and guiding wedges 204, and, working from the reverse side of the patchwork assembly, the U-shaped supports 152 are removed one by one, while the gripping bands, batting and fabric are stapled together with staples 82 as shown on FIG. 4.

These innovative methods making use of a kit according to the invention produce on the front of the quilted wall hanging, seam lines very similar to the conventional ones. Moreover, the article has the flexible free-floating appearance of a traditional quilted article and is limited in its flexibility only by the network of gripping bands.

B) Rigid Quilted Decorative Panels in the Applique Craft Tradition

A spline and groove attachment technique can be used for attaching a piece of fabric to a rigid panel with a kit including gripping bands according to the invention. Such a spline and groove technique is known but is improved by the present invention which provides gripping bands that fit into the grooves (FIG. 9).

The manufacture of rigid quilted decorative panels offers great opportunities thanks to the use of the gripping bands that can be inserted into all kinds of panels such as wood, laminates, particle boards, plaster, or any other hard substrates, such as ceiling tiles, wall tiles, foam, other filling, cements gypsum products, molded products and wood.

For Rigid Panels

Dovetail grooves are cut, as shown at 75 in FIG. 9, into a rigid panel 71 along the lines of a chosen pattern. Then pads 69 and gripping bands 1 are inserted into the dovetail grooves to form padded gripping bands and, section by section, as shown on FIG. 2, patches of fabric and batting are applied by pushing excess fabric provided along their edges into the padded gripping bands along a guiding wedge by means of a round-ended blade. This applique technique allows for a full panel to be decorated with simulated quilting.

For Resilient and Easy-to-cut Panels

Figure 11:
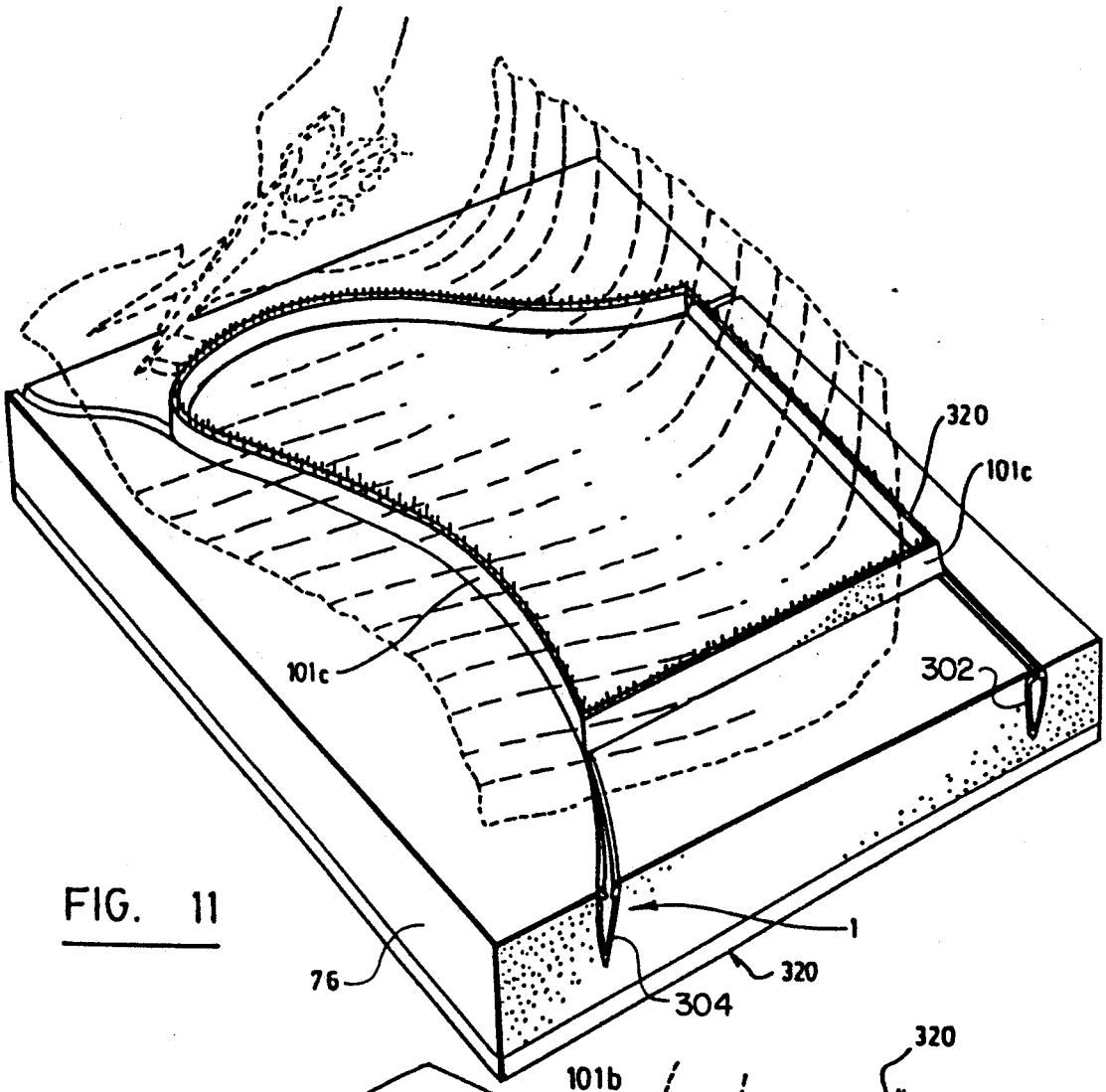
FIGS. 11 and 12 are perspective views showing a kit according to the invention in use and emphasizing the versatility of the guiding-wedge according to the invention as a pattern-guide, a wedge and a pinning device.
Figure 12:
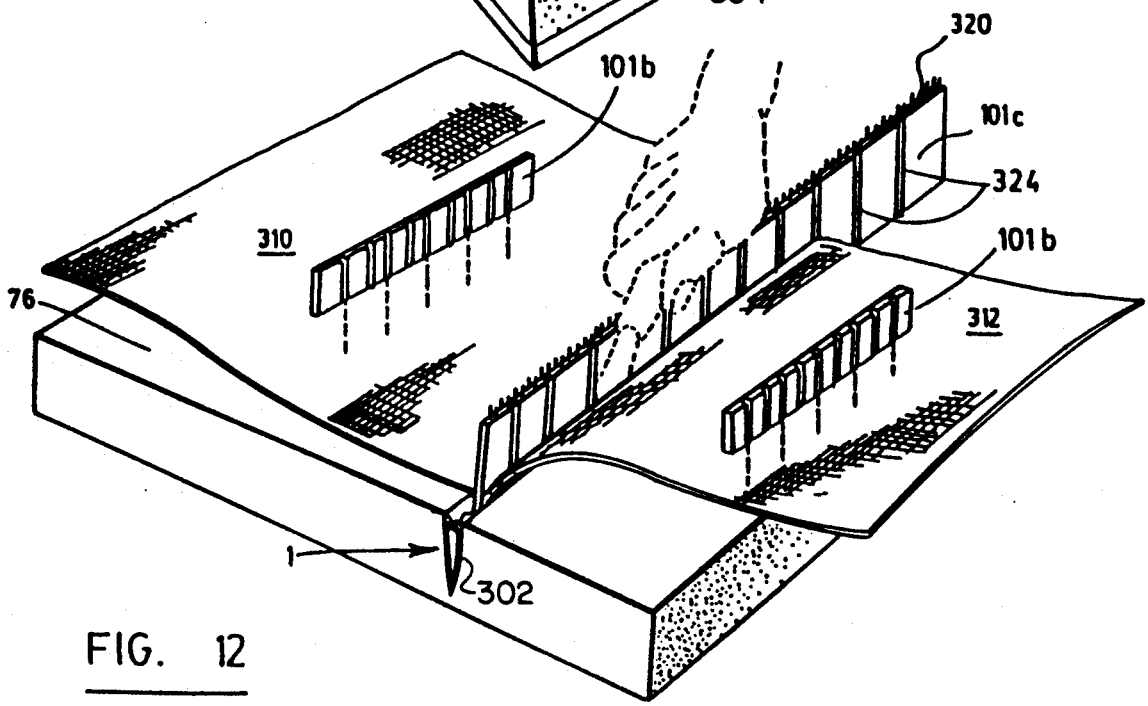

If a resilient and relatively easy-to-cut panel 76 is used, as shown in FIGS. 10, 11 and 12, for instance an expanded polystyrene panel, slits as shown at 302, 304 in FIGS. 11 and 12 can be made in it with a fine saw, such as an X-ACTO keyhole saw blade no. 15, to a depth substantially equal to the height of the gripping bands 1. The gripping bands 1 are then inserted in the slits with a set of guiding wedges 101*c* inserted in them, and patches 310,312 of fabric and batting are applied section by section by force-fitting with a blade into the reinforcing gripping bands, excess of fabric and batting especially provided for this purpose.

A panel of expanded polystyrene and the like, when slit along its surface, offers in these slits relatively good gripping qualities (see U.S. Pat. No. 4,814,218—Mar. 21, 1989; U.S. Pat. No. 3,570,435—Mar. 16, 1971; or U.S. Pat. No. 4,514,175—Apr. 30, 1985). However, when several slits are closely juxtaposed or when several slits meet at a point, the polystyrene loses most of its strength and is no longer capable of enduring the pushing and punching of the blade.

In the event of an area of foam collapsing, the support below the fabric will be weakened and the fabric will be insecurely attached, compromising also the visual integrity of the quilted panel.

The gripping bands FIG. 6 used in the kit according to the invention reinforce the foam along the edges of all slits, especially in foam of low density, and thus ensure stable, visually exact and predictable seam lines. The reinforcing presence of the gripping bands in the slits will also permit successful insertion of heavy-textured fabrics into the foam. Where foam is used, boards of one inch or less in thickness are preferably mounted on plywood 370, or any hard panel for additional strength.

With the kits according to the invention, a wide variety of graphic designs, such as geometric forms, abstractions, nature interpretations, fabric fantasies, can be created in a wide range of sizes from single tiles to very large murals and can easily be repaired if necessary, producing rigid simulated quilted panels of lasting quality and reliable craftsmanship.

DETAILED DESCRIPTION OF THE ACCESSORIES

In addition to the gripping bands, the invention provides auxiliary tools and accessories for attaching the patches of fabric and batting together and thus producing a simulated quilted craft article with predictable, reliable results.

The Guiding Wedge

The guiding wedge 101*a* in FIG. 2, 101*b* in FIG. 3, 101*c* in FIGS. 11 and 12 and 101*d* in FIG. 22 is a longitudinal element of a height normally higher than the height of the gripping bands, which acts as a guide for the fabric and batting, as a pinning tool and as a wedge. This element is provided with vertical serrations or bulges 324 over its length, and preferably with a sharp bottom edge 326 (see FIG. 22) to make its insertion easier. It is a very important auxiliary tool to the gripping band. Because it protrudes above the band, it indicates at all times the position of the band. As a pinning tool, it holds the band firmly in position during the insertion therein of the fabric and batting. As a wedge, it creates an opening at the level of the serrations when inserted in the gripping band opening. Then, by means of a small round-ended blade, one may push the excess fabric and batting together against the guiding wedge and down into the opening past the serrations of the band, thereby allowing securing of the fabric and batting in position.

Another function of the guiding wedge is to allow the fabric and batting of adjacent sections to be inserted on each side of it a same gripping band without undue friction. The guiding wedge thus acts as a divider and prevents the fabric inserted on the first side from being unduly pushed down into the gripping band as the fabric is inserted on the adjacent side. Thus, the surface tension on each patch or piece of fabric remains under control.

The guiding wedge may be provided with small spikes 320 as shown on FIGS. 1, 11, 12 or 22, regularly spaced apart and upwardly projecting along its top edge. These spikes that can be mounted in a removable manner into narrow vertical channels provided for this purpose (see FIG. 22 and FIG. 25), make the wedge useful as a pattern guide for cutting and shaping the pieces of fabric and batting which must be cut somewhat larger than the area to be covered, to leave excess fabric and batting for insertion in the gripping bands. The pieces of fabric and batting are placed together over the area defined by the guiding wedge, then stretched as shown in FIG. 12 and finally secure on the spikes 320. With scissors having a spacing element attached thereto, such as, for example, a one-centimeter large cube of foam, the fabric and batting are cut following the outer contour of the guiding-wedge, resulting in pieces of fabric and batting accurately shaped and ready to be attached.

The guiding wedge may also be provided with pins 322 as shown in FIGS. 2, 3 and 22, which are regularly spaced apart and downwardly projecting along its bottom edge. The pins may be part of the guiding wedge or be removably insertable into vertical holes 326 provided for this purpose as shown in FIG. 22. The pins may be of conventional structure or may be shaped as shown in FIG. 25 with an integral spike 327 and a small handle 329 that can straddle on the guiding wedge. Removable pins improve the precision in use and make the kit easier to use. The pins may also be used to temporarily fix the gripping bands onto a support in any preselected pattern as was already explained hereinabove. They may also be used for holding the patches or pieces of fabric in position prior to and during the pushing of the excess fabric and batting into the gripping band as is shown in FIG. 12, to prevent undue pulling exerted in one direction or another. With fabric which could permanently be damaged by holes made by the pins or with substrate panels which are very hard and difficult to penetrate, blocking be achieved with lead weights temporarily placed on the surface of the fabric. This temporary blocking insures an uniform distribution of tension from one section to the other all along the seam lines of the quilted article, regardless of the number of sides being attached in the gripping bands.

Piping-bands

As shown in FIG. 15, in order to create a simulated quilted article that has a more tactile quality, the seam lines may be completed with a piping 115 consisting of a strips of fabric 116 folded over a cord 117 and tucked into the seam lines using a round-ended blade, where they are immediately gripped by friction and pressure. In the case of gripping bands with compressing rings or in the case of rigid panels, the piping can be added when the entire assembly is completed or just prior to the removal of the guiding wedge.

In accordance with the invention, there are also provided new T-shaped, semi-rigid, flexible, time-saving piping-bands 114 (see FIG. 13 and FIGS. 14*a* to 14*c*). The piping-bands 114 may be inserted after the sheets have been introduced into the gripping bands. Alternatively, they may be inserted directly into slots provided in a rigid panel with no fabric or batting on it just to form a decorative design made of pipings only, allowing for pure linear expression. As shown in FIG. 14*a*, the T-shaped piping band 114 comprises a semi-rigid base 114*a* provided with gripping means 114*b*. A decorative bead 114*c* is mounted at the top of the base 114*a*. The bead may have a fabric, a paint or a varnish finish, as desired. As shown in FIG. 14*b*, the bead can be of circular cross-section as shown at 114*d*, of half circular cross-section or of any other shape as desired, as shown at 114*e*.

Although the invention has been described with reference to the use of fabric and batting, any other sheets of decorative material may be used. Thus, plastic films sheets and other sheets could be similarly mounted, as was indicated above. When fabrics are used, it is preferable to chemically treat such fabrics against humidity and other deteriorating agents.

The kit according to the invention which includes a plurality of gripping bands with or without a guiding wedge and a plurality of piping-bands, may be used as an individual decorative activity, and may be applied or adapted to a fully automated manufacturing process. It may also be adapted for the marketing of complete kits ready to be assembled.

As shown in FIG. 3, temporary band-holders 152 may be used for supporting the gripping bands 1. One of the preferred ways of making these band holders is to provide a U-shaped base 152 and to insert within this U-shaped base a pair of resilient substrate or pads 156–158 to receive therebetween the gripping band 1. Within the gripping band may be inserted the sheets as was indicated hereinabove.

Modifications to the above will be evident to those skilled in the art, without departing from the spirit of the invention as defined in the appended claims.

Thus, by way of example, a gripping band could be made as shown in FIG. 21, with walls 120, 121 made of semi rigid plastic materials and provided with anchors 124, 126. Gripping teeth 128, 130 are provided as gripping means.

The walls are provided with flanges that extend over the substrate and are held therein by anchoring means such as shown at 132, 134 or by other fastening means such as bolts, screws. If desired, bulges 138 or continuous rims may be used as outwardly projecting anchors.

I claim:

1. A kit for use to produce a decorative article from pieces of fabric or any other similar material comprising a plurality of gripping bands for use to attach at least one edge of at least one of said pieces of fabric or any other similar material, each of said gripping band comprising:

a pair of elongated members consisting of walls, bars or rods flexible along their lengths, said elongated members having surfaces hereinafter called "inner surfaces", that face each other, said elongated members also having adjacent edges flexibly connected to each other and free edges opposite said adjacent edges, said free edges facing each other;

gripping means projecting from said inner surface to grip and retain said at least one edge when it is inserted between said elongated members from said free edges; and compressing means to press said elongated member and free edges toward each other, wherein said compressing means consist of a plurality of open rings made of resilient material that are spaced apart along said elongated members and mounted thereon in such a manner as to pinch said members toward each other.

2. The kit of claim 1, wherein for each of said gripping bands:

said elongated member consist of walls made from a single strip of plastic material folded along a central foldline, said strip having opposite edges defining said free edges of said gripping band; and said gripping means consist of serrations die-cut into said strip and projecting at an angle toward said foldline.

3. The kit of claim 2, wherein said gripping means and compressing means are embedded into a slotted docile strip made of a material selected from the group consisting of molded elastomeric foam, rubber and silicone.

4. The kit of claim 1, wherein said elongated members of each of said gripping bands are formed by rods or bars pinched by said open rings.

5. The kit of claim 1, wherein the elongated members of each of said gripping bands are provided with lines of weakness to increase their flexibilty.

6. The kit of claim 1, wherein each of said gripping bands further comprises:

strips made of non-resilient soft metal, said strips being mounted onto said walls adjacent said free edges to rigidify the gripping band and hold it in any selected angular position.

7. The kit of claim 1 wherein each of said gripping bands further comprises:

wires made of non-resilient soft metal, said wires being mounted into said elongated members adjacent said free edges to rigidify the gripping band and hold it in any selected angular position.

8. The kit of claim 1, wherein said gripping means and compressing means are embedded into a slotted docile strip made of a material selected from the group consisting of molded elastometric foam, rubber and silicone.

9. A kit for use to produce a decorative article from pieces of fabric or any other similar material comprising a plurality of gripping bands for use to attach at least one edge of at least one of said pieces of fabric or any other similar material, each of said gripping band comprising:

a pair of elongated members consisting of walls, bars or rods flexible along their lengths, said elongated members having surfaces, hereinafter called "inner surface", that face each other, said elongated members also having adjacent edges flexibly connected to each other and free edges opposite said adjacent edges, said free edges facing each other; and gripping means projecting from said inner surfaces to grip and retain said at least one edge when it is inserted between said elongated members from said free edges, wherein each of said gripping bands further comprises:

strips made of non-resilient soft metal, said strips being mounted onto said elongated members adjacent said free edges to rigidify the gripping band and hold it in any selected angular position.

10. The kit of claim 9 which each of said gripping bands further comprises:

anchoring means outwardly projecting from said walls opposite said inner surface.

11. The kit of claim 10, wherein for each of said gripping bands:

said elongated members consists of walls made from a single strip of plastic material folded along a central foldline, said strip having opposite edges defining said free edges of said gripping band;

said gripping means consist of serrations die-cut into said strip and projecting at an angle toward said foldline; and said anchoring means consist of spear-defining members die-cut into said strip, said members projecting outwardly at angle toward said free edges.

12. The kit of claim 11, wherein said serrations are made in the opposite edges of the strip acting as said free edges, said opposite edges being folded inwardly downwardly toward said fold line.

13. The kit of claim 10, wherein the elongated members of each of said gripping bands are provided with lines of weakness to increase their flexibility.

14. The kit of claim 9, wherein said gripping means and compressing means are embedded into a slotted docile strip made of a material selected from the group consisting of molded elastomeric foam, rubber and silicoe.

15. A kit for use to produce a decorative article from pieces of fabric or any other similar material comprising a plurality of gripping bands for use to attach at least on edge of at least one of said pieces of fabric or any other similar material, each of said gripping band comprising:

a pair of elongated members consisting of walls, bars or rods flexible along their lengths, said elongated members having surfaces, hereinafter called "inner surface", that face each other, said elongated members also having adjacent edges flexibly connected to each other and free edges opposite said adjacent edges, said free edges facing each other; and gripping means projecting from said inner surfaces to grip and retain said at least one edge when it is inserted between said elongated members from said free edges, wherein each of said gripping bands further comprises:

wires made of non-resilient soft metal, said wires being mounted into said elongated members adjacent said free edges to rigidify the gripping band and hold it any selected angular position.

16. A kit for use to produce a decorative article from pieces of fabric or any other similar material, comprising a plurality of gripping bands for use to attach at least one edge of at least one of said pieces of fabric or any other similar material, each of said gripping band comprising:

a pair of elongated members consisting of walls, bars or rods flexible along their lengths, said elongated members having surfaces, hereinafter called "inner surface", that face each other, said elongated members also having adjacent edges flexibly connected to each other and free edges opposite said adjacent edges, said free edges facing each other; and gripping means projecting from said inner surfaces to grip and retain said at least one edge when it is inserted between said elongated members from said free edges, said kit further comprising at least one guiding wedge in the form of a thin elongated element higher then the elongated members of said gripping bands, said guiding wedges having vertically serrated, flexible walls and being temporarily mountable into each of said gripping bands to facilitate the insertion of the edges of said pieces of fabric or other material into said gripping bands.

17. The kit of claim 16, wherein said at least one guiding wedge has a bottom edge with pins projecting down and a top edge with small spikes projecting up.

18. The kit of claim 16, wherein said at least one guiding wedge is provided with a plurality of equally spaced-apart, narrow vertical channels in which pins can be removably inserted.

19. The kit of claim 18, wherein at least some of said pins is provided with a small handle and with a spike upwardly projecting therefrom.

20. The kit of claim 19, further comprising flexible piping bands each comprising a bead from which extends a semi rigid base provided with gripping means, said bases being insertable into said gripping bands to fix said piping bands and hide cover seam lines left between said pieces of fabric or similar material along said gripping bands.

21. The kit of claim 16, further comprising flexible piping bands each comprising a bead from which extends a semi rigid base provided with gripping means, said bases being insertable into said gripping bands to fix said piping bands and hide cover seam lines left between said pieces of fabric or similar material along said gripping bands.

22. A kit for use to produce a decorative article from pieces of fabric or any other similar material, comprising a plurality of gripping bands for use to attach at least one edge of at least one of said pieces of fabric or any other similar material, each of said gripping band comprising:

a pair of elongated members consisting of walls, bars or rods flexible along their lengths, said elongated members having surfaces, hereinafter called "inner surface", that face each other, said elongated members also having adjacent edges flexibly connected to each other and free edges opposite said adjacent edges, said free edges facing each other; and gripping means projecting from said inner surfaces to grip and retain said at least on edge when it is inserted between said elongated members from said free edges, said kit further comprising flexible piping bands each comprising a bead from which extends a semi rigid base provided with gripping means, said bases being insertable into said gripping bands to fix said piping bands and hide cover seam lines left between said pieces of fabric or similar material along said gripping bands.

* * * * *